US009162447B2

(12) United States Patent
Akiyama

(10) Patent No.: US 9,162,447 B2
(45) Date of Patent: Oct. 20, 2015

(54) IMAGE FORMING APPARATUS

(71) Applicant: Kohta Akiyama, Tokyo (JP)

(72) Inventor: Kohta Akiyama, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/767,140

(22) Filed: Feb. 14, 2013

(65) Prior Publication Data

US 2013/0215173 A1 Aug. 22, 2013

(30) Foreign Application Priority Data

Feb. 18, 2012 (JP) ..... 2012-033463

(51) Int. Cl.
*B41J 2/045* (2006.01)
*B41J 2/14* (2006.01)

(52) U.S. Cl.
CPC ..... *B41J 2/04588* (2013.01); *B41J 2/04553* (2013.01); *B41J 2/04581* (2013.01); *B41J 2/04593* (2013.01); *B41J 2/14274* (2013.01); *B41J 2002/14403* (2013.01)

(58) Field of Classification Search
CPC ..... B41J 2/04581; B41J 2/04541
See application file for complete search history.

(56) References Cited

U.S. PATENT DOCUMENTS 6,354,685 B1 * 3/2002 Ohashi ..... 347/11
2011/0141528 A1 * 6/2011 Hirano et al. ..... 358/3.13

FOREIGN PATENT DOCUMENTS

JP 2004-160903 6/2004
JP 2008-229890 10/2008

* cited by examiner

*Primary Examiner* — Justin Seo
(74) *Attorney, Agent, or Firm* — Harness, Dickey & Pierce

(57) ABSTRACT

An image forming apparatus includes: and a unit that electrically shuts off a pressure generating unit corresponding to a nozzle ejecting no droplet, from a drive waveform generating unit for a period of a time Tb satisfying a relation Tb≥T2, and that applies, at a time after the shutoff, a voltage of a potential V1 to the pressure generating unit, where a potential serving as a reference for the drive waveform is denoted as V1, a minimum potential difference from the potential V1 required to displace a pressure generating unit to vibrate a meniscus with ejecting no liquid droplet from a nozzle is denoted as ΔV2, a time required for a potential to drop by the potential difference ΔV2 due to self-discharge after a pressure generating unit is charged to a predetermined potential is denoted as T2.

6 Claims, 11 Drawing Sheets

FIG.12

| | Tb [μs] | | | | | |
|---|---|---|---|---|---|---|
| | 100 | 200 | 500 | 1000 | 2000 | 10000 |
| EJECTABILITY AFTER BEING LEFT STANDING | × | × | × | △ | ○ | ○ |

IMAGE FORMING APPARATUS

CROSS-REFERENCE TO RELATED APPLICATIONS

The present application claims priority to and incorporates by reference the entire contents of Japanese Patent Application No. 2012-033463 filed in Japan on Feb. 18, 2012.

BACKGROUND OF THE INVENTION

1. Field of the Invention

The present invention relates to an image forming apparatus, and particularly to an image forming apparatus that is provided with a print head ejecting liquid droplets.

2. Description of the Related Art

As image forming apparatuses such as printers, facsimile apparatuses, copying apparatuses, plotters, and MFPs combining these functions, there are known, for example, liquid ejection recording type image forming apparatuses, such as inkjet recording apparatuses, which use, as a print head, a liquid ejection head that ejects liquid droplets.

As a method of driving the liquid ejection head in such an image forming apparatus, there is known a method in which, to a pressure generating unit in a head for a nozzle from which no liquid droplet has been ejected (hereinafter referred to as a non-ejection nozzle), a so-called minute-drive waveform is applied, which causes meniscus of the nozzle to vibrate with causing no liquid droplet to be ejected, to maintain the nozzle.

If the minute-drive waveform is applied to all of the nozzles from which no droplet has ejected, large electric power consumption occurs. Therefore, there is known a method to reduce the power consumption by applying the minute-drive waveform only to the non-ejection nozzles that have continued to be in the non-ejection state for a predetermined period of time or by predetermined times.

There is also known an apparatus in which, in order to reduce the power consumption, crosstalk occurring between adjacent liquid chambers is used and the adjacent nozzles are sequentially driven at a slight time difference therebetween so as to obtain a large effect of the minute-drive with a small number of times of the drive (Japanese Patent Application Laid-open No. 2008-229890).

However, there is a problem that increasing the interval of the sequential minute-drive reduces the effect of the minute-drive, and thus makes it impossible to maintain stable droplet ejection characteristics.

In the apparatus that uses the crosstalk, it is necessary to apply a large number of pulses in a short period of time and select pulse for each head. Therefore, there is also a problem that a minute-drive waveform must be generated and switched at a high speed in a very short period of time. There is also a problem that this method cannot be applied to heads that have small crosstalk and thus can perform stable droplet ejection, and therefore can be applied only to heads that have large crosstalk and thus inherently cannot perform stable droplet ejection.

In view of the above-described problems, there is a need to reduce electric power consumption with a simple configuration.

SUMMARY OF THE INVENTION

It is an object of the present invention to at least partially solve the problems in the conventional technology.

An image forming apparatus includes: a print head that is a unit including a plurality of nozzles ejecting droplets of liquid and a plurality of pressure generating units generating pressure to eject the droplets of liquid from the nozzles, the pressure generating units being units in which self-discharge occurs; a drive waveform generating unit that generates a drive waveform applied to each of the pressure generating units in the print head; and a unit that electrically shuts off a pressure generating unit corresponding to a nozzle ejecting no droplet, from the drive waveform generating unit for a period of a time Tb satisfying a relation $Tb \geq T2$, and that applies, at a time after the shutoff, a voltage of a potential V1 to the pressure generating unit corresponding to the nozzle ejecting no droplet, where a potential serving as a reference for the drive waveform is denoted as V1, a minimum potential difference from the potential V1 required to displace a pressure generating unit to vibrate a meniscus with ejecting no liquid droplet from a nozzle is denoted as $\Delta V2$, a time required for a potential to drop by the potential difference $\Delta V2$ due to the self-discharge after a pressure generating unit is charged to a predetermined potential is denoted as T2, a time from an immediately preceding droplet ejection operation until an abnormality occurs in a next droplet ejection operation due to that a liquid surface in a nozzle of the print head is dried, is denoted as Ta, a time to hold a state in which the drive waveform generating unit and a pressure generating unit are electrically shut off from each other is denoted as Tb, and a relation $Ta > T2$ is satisfied.

A method of controlling a print head having a plurality of nozzles ejecting droplets of liquid and a plurality of pressure generating units generating pressure to eject the droplets of liquid from the nozzles, the pressure generating units being units in which self-discharge occurs, includes: causing a drive waveform generating unit to generate a drive waveform applied to each of the pressure generating units in the print head; and electrically shutting off a pressure generating unit corresponding to a nozzle ejecting no droplet, from the drive waveform generating unit for a period of a time Tb satisfying a relation $Tb \geq T2$, and applying, at a time after the shutoff, a voltage of a potential V1 to the pressure generating unit corresponding to the nozzle ejecting no droplet, where a potential serving as a reference for the drive waveform is denoted as V1, a minimum potential difference from the potential V1 required to displace a pressure generating unit to vibrate a meniscus with ejecting no liquid droplet from a nozzle is denoted as $\Delta V2$, a time required for a potential to drop by the potential difference $\Delta V2$ due to the self-discharge after a pressure generating unit is charged to a predetermined potential is denoted as T2, a time, from an immediately preceding droplet ejection operation until an abnormality occurs in next a droplet ejection operation due to that a liquid surface in a nozzle of the print head is dried, is denoted as Ta, a time to hold a state in which the drive waveform generating unit and a pressure generating unit are electrically shut off from each other is denoted as Tb, and a relation $Ta > T2$ is satisfied.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 12 is an explanatory diagram for explaining setting of a time Td.

DETAILED DESCRIPTION OF THE PREFERRED EMBODIMENTS

Figure 1:
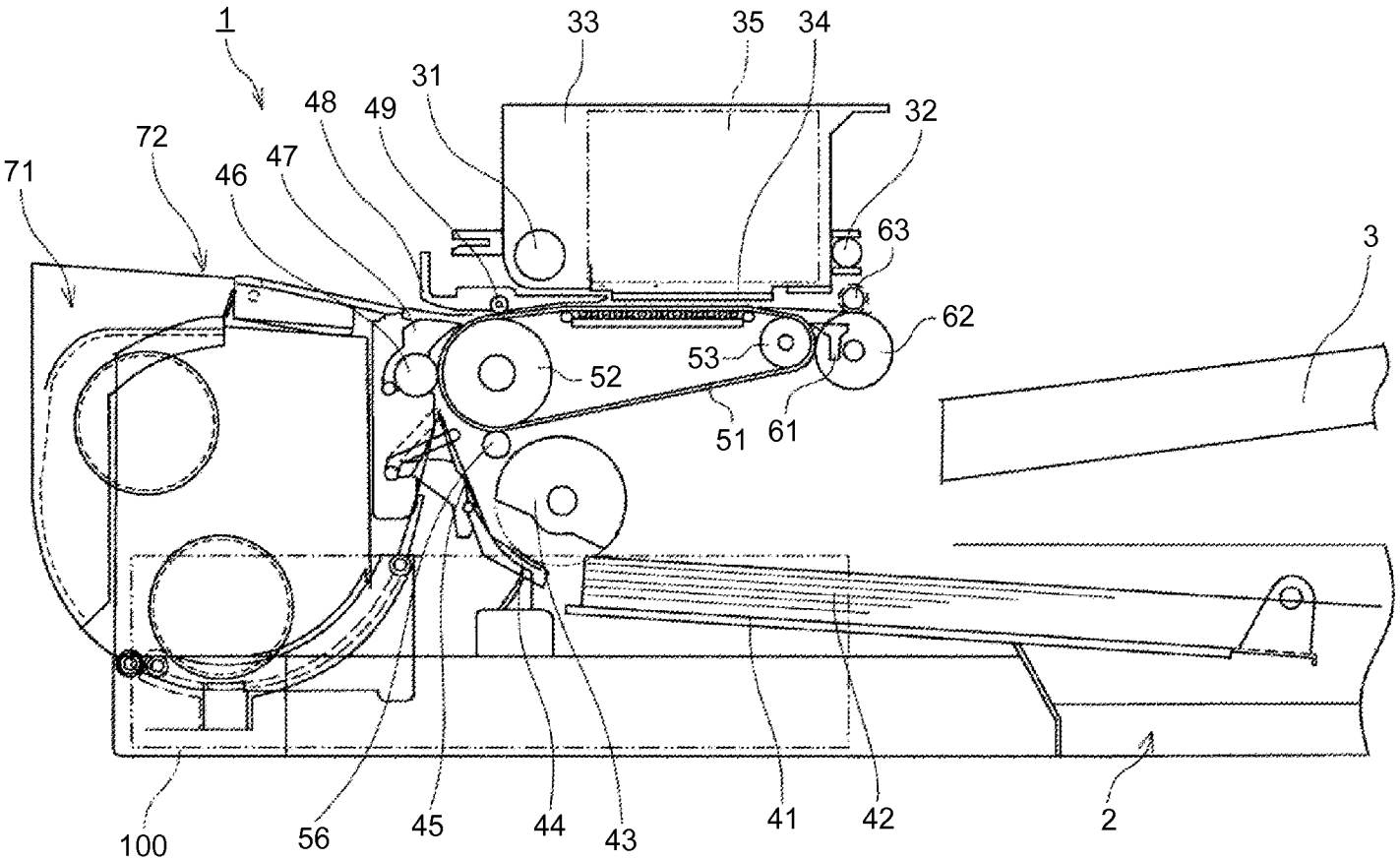
FIG. 1 is an explanatory side view explaining a mechanism of an image forming apparatus according to an embodiment of the present invention.

An embodiment of the present invention will be described below with reference to the accompanying drawings. First, an example of an image forming apparatus according to the present invention will be described with reference to FIGS. 1 and 2. FIG. 1 is an explanatory side view explaining an overall configuration of the image forming apparatus, and FIG. 2 is an essential part plan view explaining the apparatus.

Figure 2:
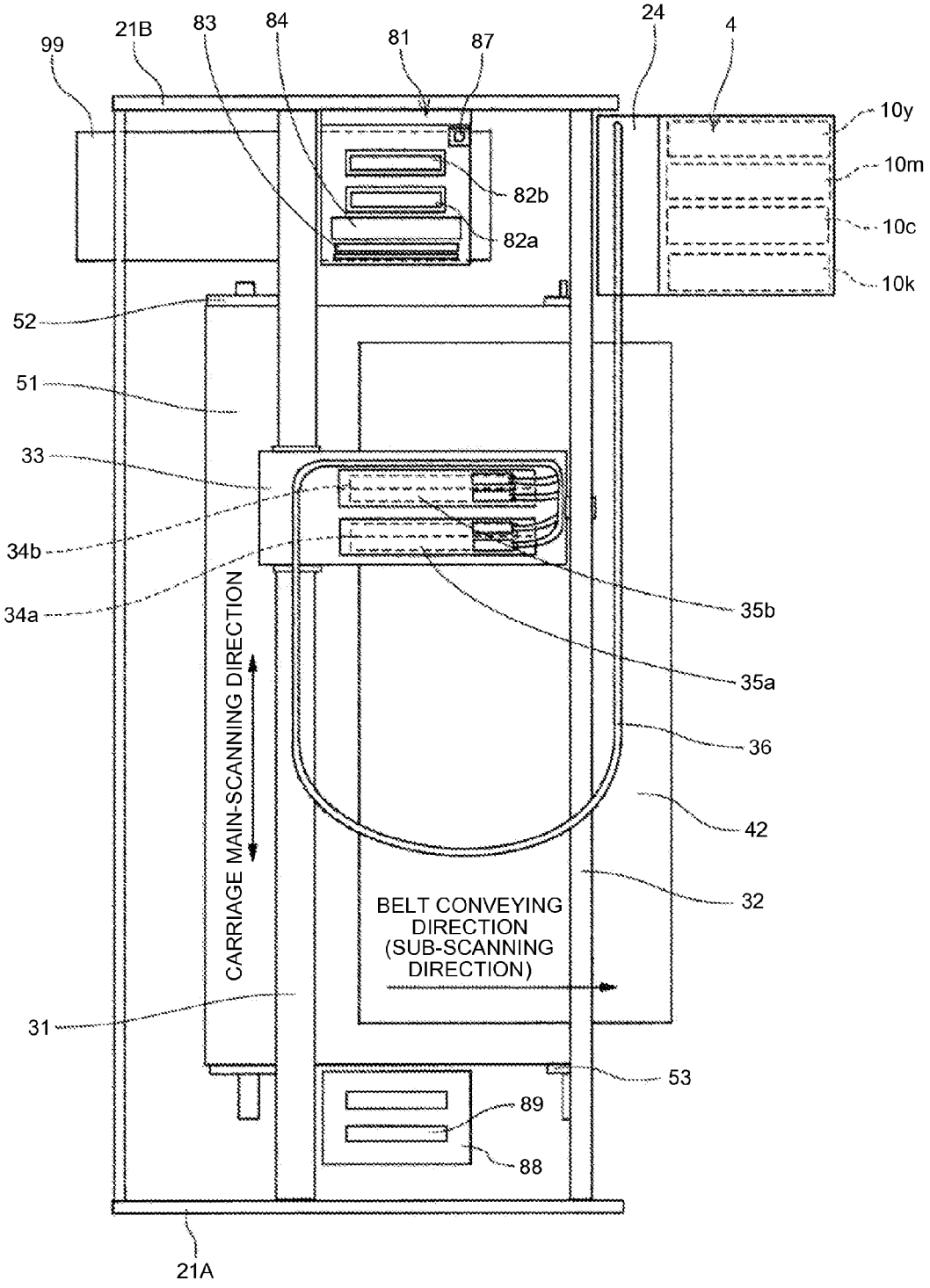
FIG. 2 is an essential part plan view explaining the mechanism.

This image forming apparatus is a serial inkjet recording apparatus, in which a carriage 33 is held in a slidable manner in the main-scanning direction by main and sub guide rods 31 and 32 serving as guide members supported by right and left side panels 21A and 21B of a apparatus body 1 to laterally extend, and is moved by a main-scanning motor (not illustrated) via a timing belt to perform scanning in the direction (carriage main-scanning direction) indicated by an arrow in FIG. 2.

On the carriage 33, print heads 34*a* and 34*b* (called "print heads 34" when not distinguished) composed of liquid ejection heads for ejecting ink droplets having colors of yellow (Y), cyan (C), magenta (M), and black (K) are mounted so that nozzle rows thereof each composed of a plurality of nozzles extends in the sub-scanning direction perpendicular to the main-scanning direction and the ejection direction of the ink droplets is directed downward.

Each of the print heads 34 has two such nozzle rows. One and the other of the nozzle rows of the print head 34*a* eject the liquid droplets of black (K) and the liquid droplets of cyan (C), respectively, while one and the other of the nozzle rows of the print head 34*b* eject the liquid droplets of magenta (M) and the liquid droplets of yellow (Y), respectively. As the print heads 34, for example, a nozzle head provided with nozzle rows of the respective colors each formed by disposing a plurality of nozzles, in one nozzle plane can also be used.

The carriage 33 is also equipped with head tanks 35*a* and 35*b* (called "head tanks 35" when not distinguished) serving as a second ink supplying unit to supply ink of the respective colors corresponding to the nozzle rows of the print heads 34. The head tanks 35 are supplied and replenished with recording liquid of the respective colors by a supply pump unit 24 via supply tubes 36 for the respective colors from ink cartridges (main tanks) 10*y*, 10*m*, 10*c*, and 10*k* for the respective colors mounted in a detachable manner on a cartridge loading unit 4.

As a paper feeding unit to feed sheets 42 loaded on a sheet loading unit (pressurizing plate) 41 of a paper feed tray 2, a semicircular roller (paper feeding roller) 43 that separates and feeds the sheets 42 one by one from the sheet loading unit 41 and a separation pad 44 that faces the paper feeding roller 43 and is made of material having a large coefficient of friction are provided. The separation pad 44 is urged toward the paper feeding roller 43.

In addition, in order to feed the sheet 42 fed from the paper feeding unit toward a position under the print heads 34, a guide member 45 that guides the sheet 42, a counter roller 46, a conveyance guide member 47, and a pressing member 48 having a leading-edge pressing roller 49 are provided, and a conveying belt 51 serving as a conveying unit to electrostatically hold the fed sheet 42 and convey it in a position facing the print heads 34 is also provided.

The conveying belt 51 is an endless belt, and is configured to be wound between a conveying roller 52 and a tension roller 53 so as to move around in the belt conveying direction (sub-scanning direction). A charging roller 56 serving as a charging unit to charge a surface of the conveying belt 51 is also provided. The charging roller 56 is arranged so as to be in contact with the surface layer of the conveying belt 51 and thus to rotate by being driven by the turning of the conveying belt 51. The conveying roller 52 is rotationally driven by a sub-scanning motor (not illustrated) so that the conveying belt 51 moves around in the belt conveying direction of FIG. 2.

As a discharging unit to discharge the sheet 42 on which recording has been made by the print heads 34, a separation claw 61 to separate the sheet 42 from the conveying belt 51, a discharging roller 62, a spur 63 serving as a discharging roller, and a discharge tray 3 below the discharging roller 62 are also provided.

In addition, a duplex unit 71 is mounted in a detachable manner on the rear of the apparatus body 1. The duplex unit 71 takes in the sheet 42 returned by reverse rotation of the conveying belt 51, turns over and feeds again the sheet 42 between the counter roller 46 and the conveying belt 51. The upper face of the duplex unit 71 serves as a manual bypass tray 72.

Moreover, at a non-printing area at one side in the scanning direction of the carriage 33, a maintenance and recovery mechanism 81 to maintain and recover the state of the nozzles of the print heads 34 is arranged. The maintenance and recovery mechanism 81 is provided with cap members (hereinafter called "caps") 82*a* and 82*b* (called "caps 82" when not distinguished) to cap the nozzle planes of the print heads 34, a wiper member (wiper blade) 83 to wipe the nozzle planes, an idle ejection receiver 84 that receives liquid droplets when idle ejection is performed to eject liquid droplets that do not contribute to recording in order to discharge thickened recording liquid, a carriage lock 87 that locks the carriage 33, and the like. Below the maintenance and recovery mechanism 81 for the heads, a waste liquid tank 99 to contain waste liquid produced by the maintenance and recovery operations is mounted in a replaceable manner in the apparatus body.

Furthermore, at a non-printing area at the other side in the scanning direction of the carriage 33, an idle ejection receiver 88 that receives liquid droplets when the idle ejection is performed to eject liquid droplets that do not contribute to recording in order to discharge recording liquid thickened during recording or the like is arranged. The idle ejection receiver 88 is provided, for example, with an opening 89 extending along the nozzle row direction of the print heads 34.

In the thus configured image forming apparatus, the sheets 42 are separated and fed one by one from the paper feed tray 2. Then, the sheet 42 fed substantially vertically upward is guided by the guide member 45, and is conveyed while being sandwiched between the conveying belt 51 and the counter roller 46. Further, the leading-edge of the sheet 42 is guided by the conveyance guide member 47, the sheet 42 is pressed onto the conveying belt 51 by the leading-edge pressing roller 49, and the conveying direction of the sheet 42 is changed by approximately 90 degrees.

At this time, voltage is applied to the charging roller 56 so that a positive output and a negative output are alternately repeated, and thus, the conveying belt 51 is charged by an alternating charging voltage pattern. When the sheet 42 is fed onto the conveying belt 51 thus charged, the sheet 42 is attached to the conveying belt 51, and is carried in the sub-scanning direction by the circulating movement of the conveying belt 51.

Then, the print heads 34 are driven according to an image signal so as to eject the ink droplets onto the stationary sheet 42 while the carriage 33 is moved, thus recording corresponding to one line is performed, and, after the sheet 42 is carried by a predetermined amount, recording corresponding to the next line is performed. By receiving a record termination signal or a signal indicating an arrival of the rear end of the sheet 42 at a recording area, the recording operation is terminated, and the sheet 42 is discharged to the discharge tray 3.

Then, when maintenance and recovery of the nozzles of the print heads 34 are to be performed, the carriage 33 is moved to a position serving as a home position where the carriage 33 face the maintenance and recovery mechanism 81, and is subjected to the maintenance and recovery operations such as a nozzle suction operation to perform the capping with the cap members 82 and perform suction from the nozzles, and the idle ejection operation to eject liquid droplets that do not contribute to image formation. Thus, the image formation can be performed by stable liquid droplet ejection.

Figure 3:
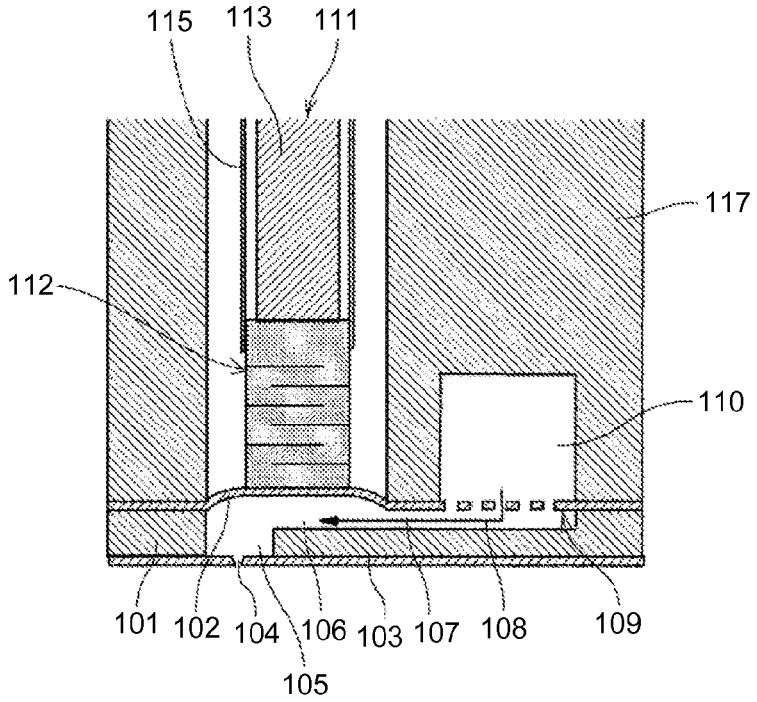
FIG. 3 is an explanatory cross-sectional view in the longitudinal direction of liquid chambers illustrating an example of a liquid ejection head constituting a print head of the image forming apparatus.
Figure 4:
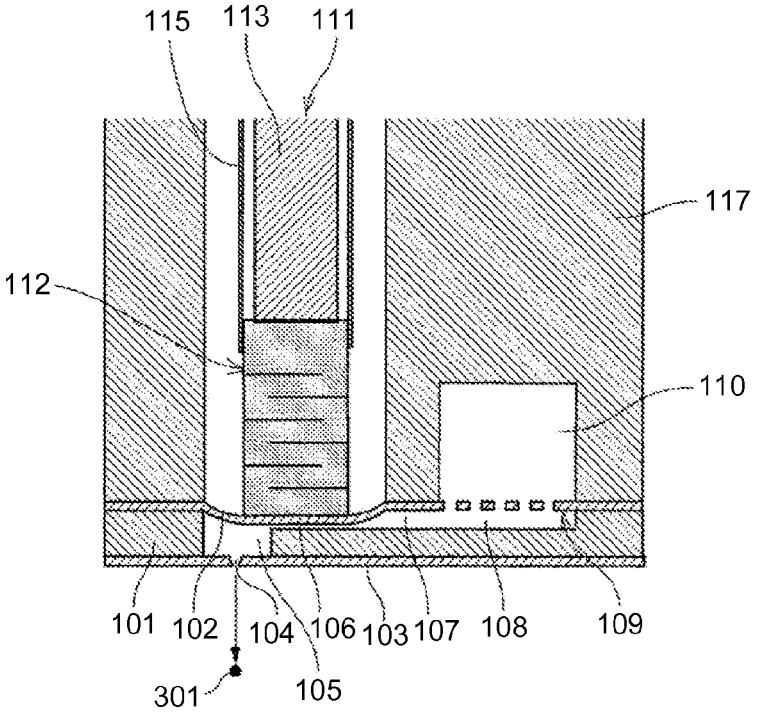
FIG. 4 is an explanatory cross-sectional view for explaining a droplet ejection operation of the liquid ejection head.

Next, an example of the liquid ejection head constituting the print heads 34 will be described with reference to FIGS. 3 and 4. FIGS. 3 and 4 are explanatory cross-sectional views along the longitudinal direction of liquid chambers (direction perpendicular to the nozzle arrangement direction) of the head.

In the liquid ejection head, a flow path plate 101, a vibration plate member 102, and a nozzle plate 103 are joined together, and there are formed individual liquid chambers (having meaning including what are called pressurizing chambers, pressurizing liquid chambers, pressure chambers, individual flow paths, and pressure generating chambers, and hereinafter simply called "liquid chambers") 106 with which nozzles 104 to discharge liquid droplets communicate via through-holes 105, fluid resistance portions 107 to supply liquid to the liquid chambers 106, and liquid introducing portions 108. Liquid (ink) is introduced from a common liquid chamber 110 formed in a frame member 117 via a filter 109 formed in the vibration plate member 102 to the liquid introducing portions 108, and supplied from the liquid introducing portions 108 via the fluid resistance portions 107 to the liquid chambers 106.

The flow path plate 101 is made by laminating a metal sheet such as a SUS sheet, and openings and grooves such as the through-holes 105, the liquid chambers 106, the fluid resistance portions 107, and the liquid introducing portions 108 are formed. The vibration plate member 102 is a wall member that forms walls of the liquid chambers 106, the fluid resistance portions 107, the liquid introducing portions 108, and the like, and is also a member that forms the filter 109. The flow path plate 101 can be formed not only by the metal sheet such as the SUS sheet but also by anisotropically etching a silicon substrate.

In addition, the surface of the vibration plate member 102 opposite to the liquid chambers 106 is joined with a laminated-type piezoelectric member 112 that is a column-like electromechanical conversion element serving as a drive element (actuator unit or pressure generating unit) that generates energy to pressurize the ink in the liquid chamber 106 and eject the ink droplet from the nozzle 104. The piezoelectric member 112 is joined, at one end thereof, to a base member 113. The piezoelectric member 112 is also connected to an FPC 115 that transmits a drive waveform. These components constitute a piezoelectric actuator 111.

While, in this example, the piezoelectric member 112 is used in d33 mode in which the piezoelectric member 112 is expanded and contracted in the laminated direction, d31 mode may be used in which the piezoelectric member 112 is expanded and contracted in a direction perpendicular to the laminated direction.

In the thus configured liquid ejection head, for example, as illustrated in FIG. 3, the piezoelectric member 112 is contracted by reducing the voltage applied to the piezoelectric member 112 from a reference potential V1, and thus, the vibration plate member 102 is deformed so that the liquid chamber 106 expands in volume and thereby the ink flows into the liquid chamber 106. Then, as illustrated in FIG. 4, the voltage applied to the piezoelectric member 112 is increased to expand the piezoelectric member 112 in the laminated direction, and thus, the vibration plate member 102 is deformed toward the nozzle 104 to contract the liquid chamber 106 in volume so that the ink in the liquid chamber 106 is pressurized and thus a liquid droplet 301 is ejected from the nozzle 104.

Then, by returning the voltage applied to the piezoelectric member 112 to the reference potential V1, the vibration plate member 102 returns to an initial position. At this time, the liquid chamber 106 expands to generate a negative pressure and thus the ink is filled into the liquid chamber 106 from the common liquid chamber 110. Then, after vibration of a meniscus surface of the nozzle 104 is attenuated and stabilized, the process shifts to the operation for next liquid droplet ejection.

Figure 5:
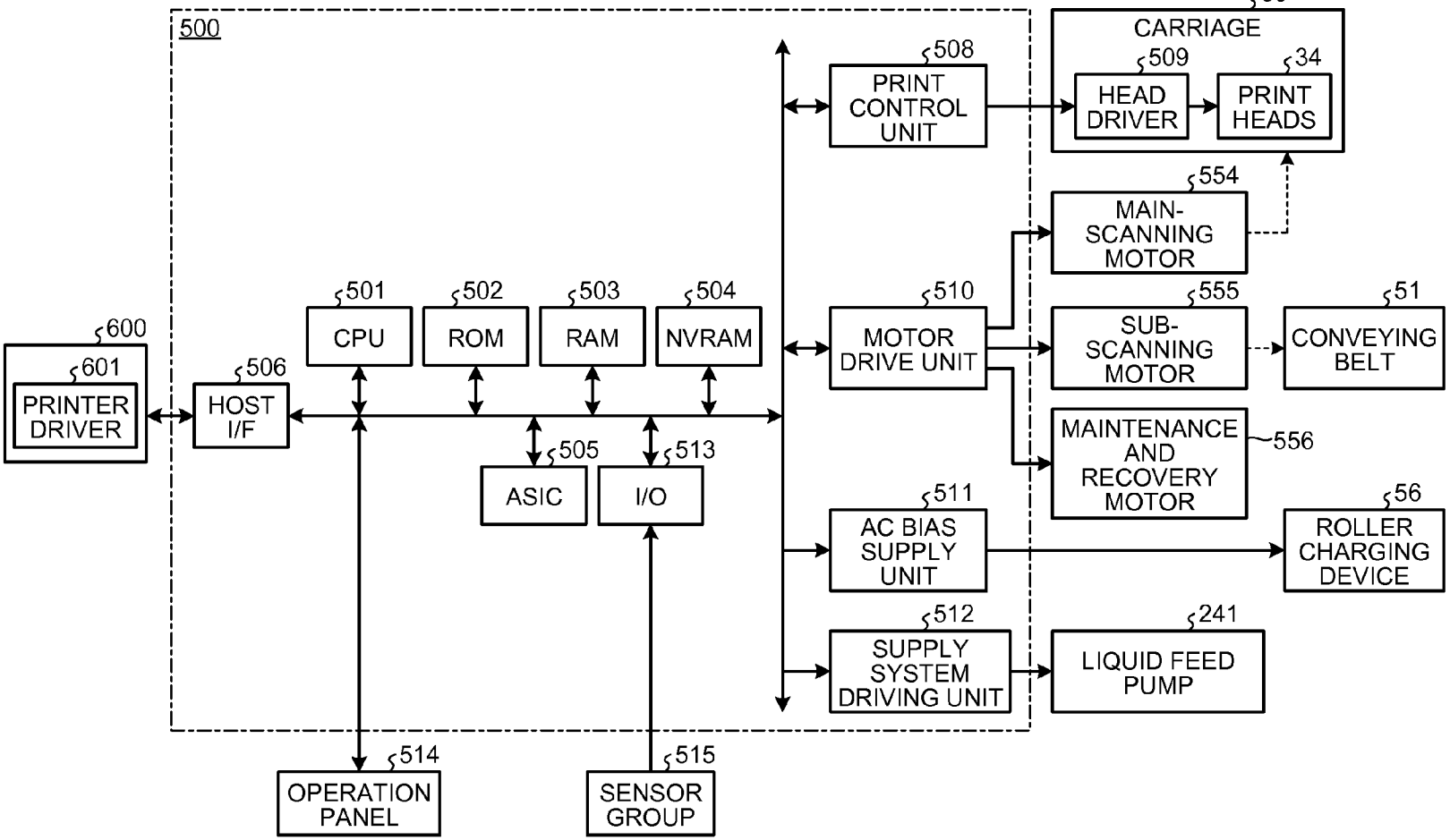
FIG. 5 is an explanatory block diagram illustrating an outline of a control unit of the image forming apparatus.

Next, an outline of a control unit of the image forming apparatus will be described with reference to FIG. 5. FIG. 5 is an explanatory block diagram of the control unit.

A control unit 500 is provided with a CPU 501 that controls the overall apparatus, a ROM 502 that stores fixed data such as various programs including a program executed by the CPU 501, a RAM 503 that temporarily stores image data and the like, a rewritable nonvolatile memory 504 for holding data even while a power supply of the apparatus is shut off, and an ASIC 505 that performs various types of signal processing on the image data and image processing such as sorting, and that processes other input/output signals for controlling the overall apparatus.

The control unit 500 is also provided with a print control unit 508 including a data transfer unit and a drive signal generating unit for controlling drive of the print heads 34; a head driver (driver IC) 509 for driving the print heads 34 provided on the side of the carriage 33; a motor drive unit 510 for driving a main-scanning motor 554 that moves the carriage 33 to perform scanning, a sub-scanning motor 555 that circulates the conveying belt 51, and a maintenance and recovery motor 556 that performs movement of the caps 82 and the wiper member 83 of the maintenance and recovery mechanism 81, maintenance and recovery of a suction pump 812, and so on; an AC bias supply unit 511 that supplies an AC bias to the charging roller 56; a supply system driving unit 512 that drives a liquid feed pump 241; and so on.

Further, an operation panel 514 for input and display operations of information necessary for the apparatus is connected to the control unit 500.

The control unit 500 has an I/F 506 for sending and receiving data and signals to/from a host side, and receives the data and the signals at the I/F 506 via a cable or a network from the host 600 such as an information processing apparatus like a personal computer, an image scanning unit like an image scanner, and an image capturing device like a digital camera.

The CPU 501 of the control unit 500 reads out and analyzes print data included in a receive buffer included on the I/F 506, and the ASIC 505 applies necessary image processing, sorting processing, and so on to the data. Then, this image data is transferred from the print control unit 508 to the head driver 509. Generation of dot pattern data for outputting an image can be performed by a printer driver 601 on the side of the host 600, or can be performed by the control unit 500.

The print control unit 508 transfers the above-described image data a serial data, and outputs, to the head driver 509, transfer clocks, latch signals, control signals, and the like necessary for transferring the image data and finalizing the transfer. In addition, the print control unit 508 includes the drive signal generating unit composed of a D/A converter that converts, from digital to analog, pattern data of drive pulses stored in the ROM, a voltage amplifier, a current amplifier, and so on, and outputs, to the head driver 509, a drive signal composed of one drive pulse or a plurality of drive pulses.

The head driver 509 selects drive pulses constituting a drive waveform given from the print control unit 508 based on the serially entered image data corresponding to one line of the print heads 34, and applies the drive pulses to the piezoelectric member 112 serving as the pressure generating unit that generates energy to eject liquid droplets of the print heads 34 so as to drive the print heads 34. At this time, dots of different sizes can be distinguished, for example, among a large droplet, a medium droplet, and a small droplet, by selecting some or all of the pulses constituting the drive waveform, or by selecting some or all of waveform elements forming the pulses.

An I/O unit 513 obtains information from a sensor group 515 of various sensors mounted on the apparatus, and extracts therefrom information necessary for controlling the printer. The extracted information is used for the control of the print control unit 508, the motor drive unit 510, and the AC bias supply unit 511. The sensor group 515 includes an optical sensor for detecting the position of the sheet, a thermistor for monitoring temperature in the apparatus, a sensor that monitors the voltage of a charging belt, an interlock switch for detecting open and close of a cover. The I/O unit 513 can process the various types of sensor information.

Figure 6:
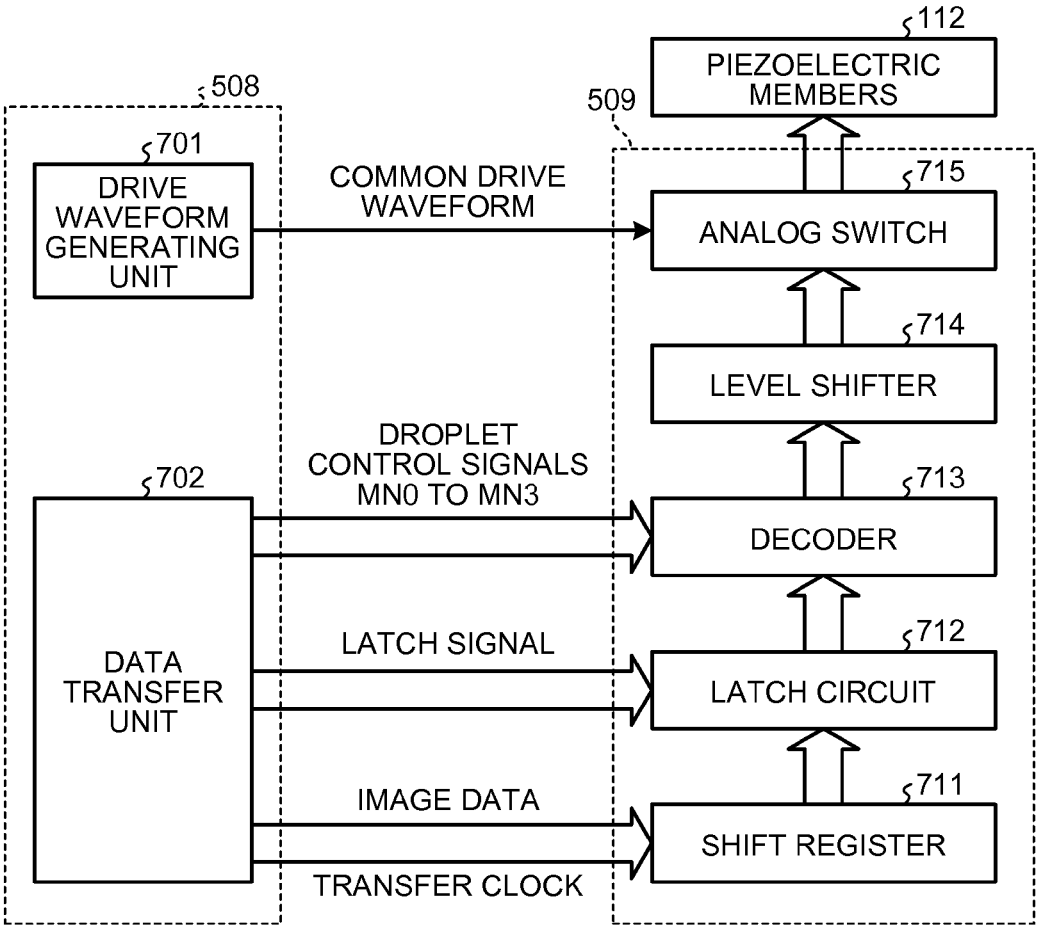
FIG. 6 is an explanatory block diagram illustrating an example of a print control unit and a head driver of the control unit.

Next, an example of the print control unit 508 and the head driver 509 will be described with reference to an explanatory block diagram of FIG. 6.

The print control unit 508 is provided with a drive waveform generating unit 701 that generates and outputs, during image formation, a drive waveform (common drive waveform) composed of a plurality of drive pulses (drive signals) in one print cycle (one drive cycle), and generates and outputs, during driving, a drive waveform for idle ejection (common drive waveform for idle ejection) composed of a plurality of drive pulses (drive signals) for idle ejection in one idle ejection cycle, and is also provided with a data transfer unit 702 that outputs two-bit image data (gradation signal 0, 1) corresponding to a print image, a clock signal, a latch signal (LAT), and droplet control signals M0 to M3. Here, the idle ejection means ejecting ink from the nozzles 104 of the liquid ejection head at appropriate intervals to suppress the drying or thickening of the ink similar to a flush process.

The droplet control signal is a two-bit signal that instructs, at each droplet, on and off of an analog switch 715 serving as a switch unit (described later) of the head driver 509, and, in synchronization with the print cycle of the common drive waveform, changes state to an H level (on) at a pulse or an waveform element to be selected while changing to an L level (off) at a pulse or an waveform element not to be selected.

The head driver 509 is provided with a shift register 711 that receives the transfer clocks (shift clocks) and the serial image data (gradation data: 2 bits/1 channel [1 nozzle]) from the data transfer unit 702; a latch circuit 712 to latch a register value of the shift register 711 using a latch signal; a decoder 713 that decodes the gradation data and the control signals MN0 to MN3 and outputs the results; a level shifter 714 that converts the level of a logic level voltage signal of the decoder 713 to a level at which the analog switch 715 can operate; and the analog switch 715 that is switched on and off (closed and opened) by the output of the decoder 713 given via the level shifter 714.

The analog switch 715 is connected to selective electrodes (individual electrodes) of the piezoelectric members 112 and receives the common drive waveform Pv from the drive waveform generating unit 701. Accordingly, the analog switch 715 is turned on according to the decoded results of the serially transferred image data (gradation data) and of the control signals M0 to M3 given by the decoder 713, and thus required pulses (or waveform elements) constituting the common drive waveform Pv are passed (selected) and applied to the piezoelectric members 112.

Next, a voltage applied to the piezoelectric element and a natural voltage drop thereof will be described with reference to FIG. 7.

Figure 7:
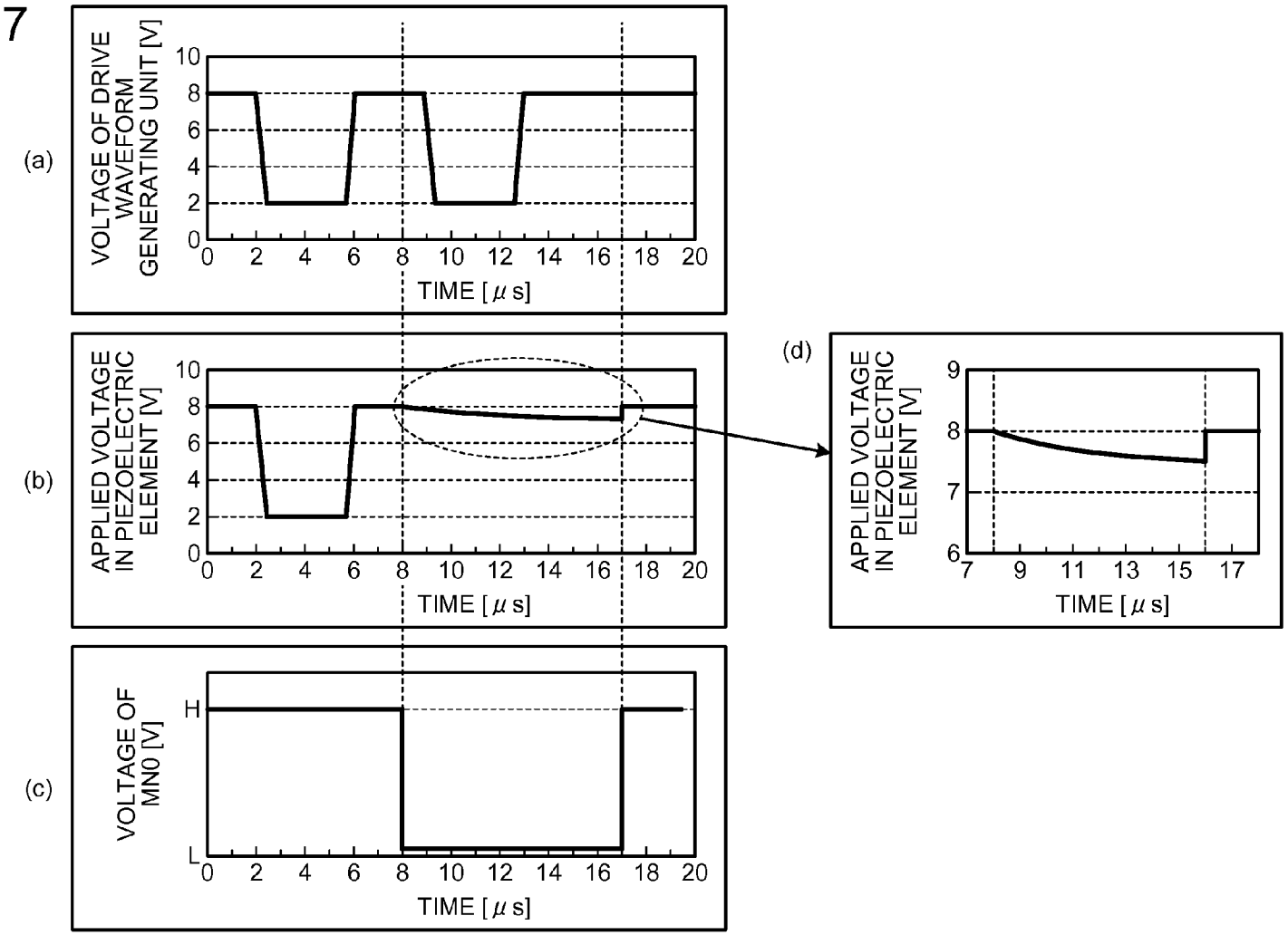
FIG. 7 is a explanatory diagram for explaining voltage changes in a piezoelectric element when drive pulses of a drive waveform are selectively applied thereto.

Assume that, as illustrated in FIG. 7(*a*), the drive waveform generating unit 701 generates and outputs a common drive waveform including drive pulses Pa and Pb that fall from the potential V1, and, after being held for a predetermined period of time, rise to the potential V1, and a droplet control signal MN0 illustrated in FIG. 7(*c*) is given to the decoder 713.

At this time, the analog switch 715 is kept on only while the droplet control signal MN0 is at an H level. Accordingly, only the drive pulse Pa is applied to the piezoelectric member (piezoelectric element) 112, as illustrated in FIG. 7(*b*).

Here, while the droplet control signal MN0 is at an "L" level, the output of the decoder 713 is kept at an "L" level, and the analog switch 715 is kept off, and thus, the drive waveform generating unit 701 and the piezoelectric element 112 are kept electrically shut off from each other.

As a result, as illustrated in FIG. 7(*b*), the potential in the piezoelectric element 112 gradually drops from the potential V1 due to self-discharge occurring in the piezoelectric element 112. FIG. 7(*d*) illustrates a partially enlarged portion corresponding to the drop in the potential due to the self-discharge.

Figure 8:
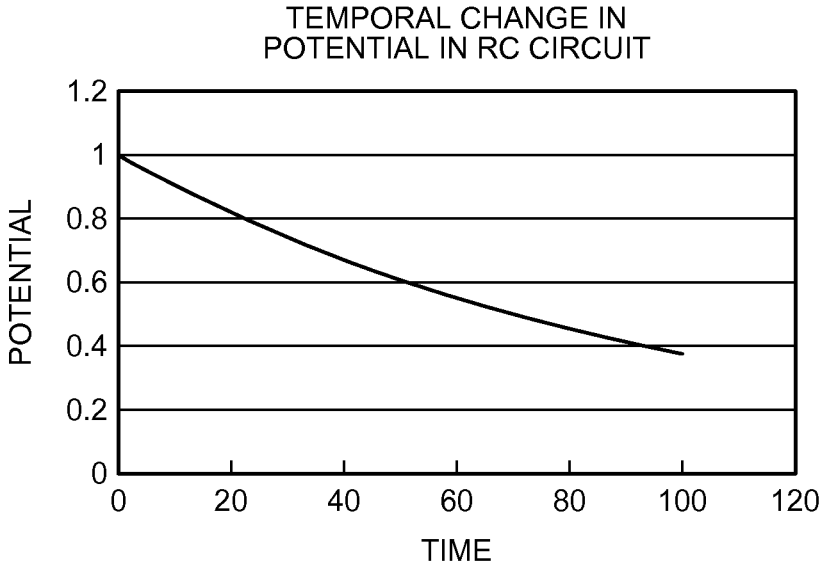
FIG. 8 is an explanatory diagram for explaining a voltage drop due to self-discharge in the piezoelectric element.

If an initial electric charge stored in the piezoelectric element 112, and a resistance R and a capacitance C between electrodes of the piezoelectric element 112 are given, the drop in the potential difference at this time can be calculated as a temporal change in the potential in an RC circuit. FIG. 8 illustrates an example of this change.

Next, a method of driving the head in the first embodiment of the present invention will be described.

In order to achieve minute-drive that can yield the same effect as that of general minute-drive with lower electric power consumption, the present invention uses the self-discharge in the piezoelectric element in the state where the drive waveform generating unit and the piezoelectric element are kept electrically shut off from each other by the analog switch described above.

Figure 9:
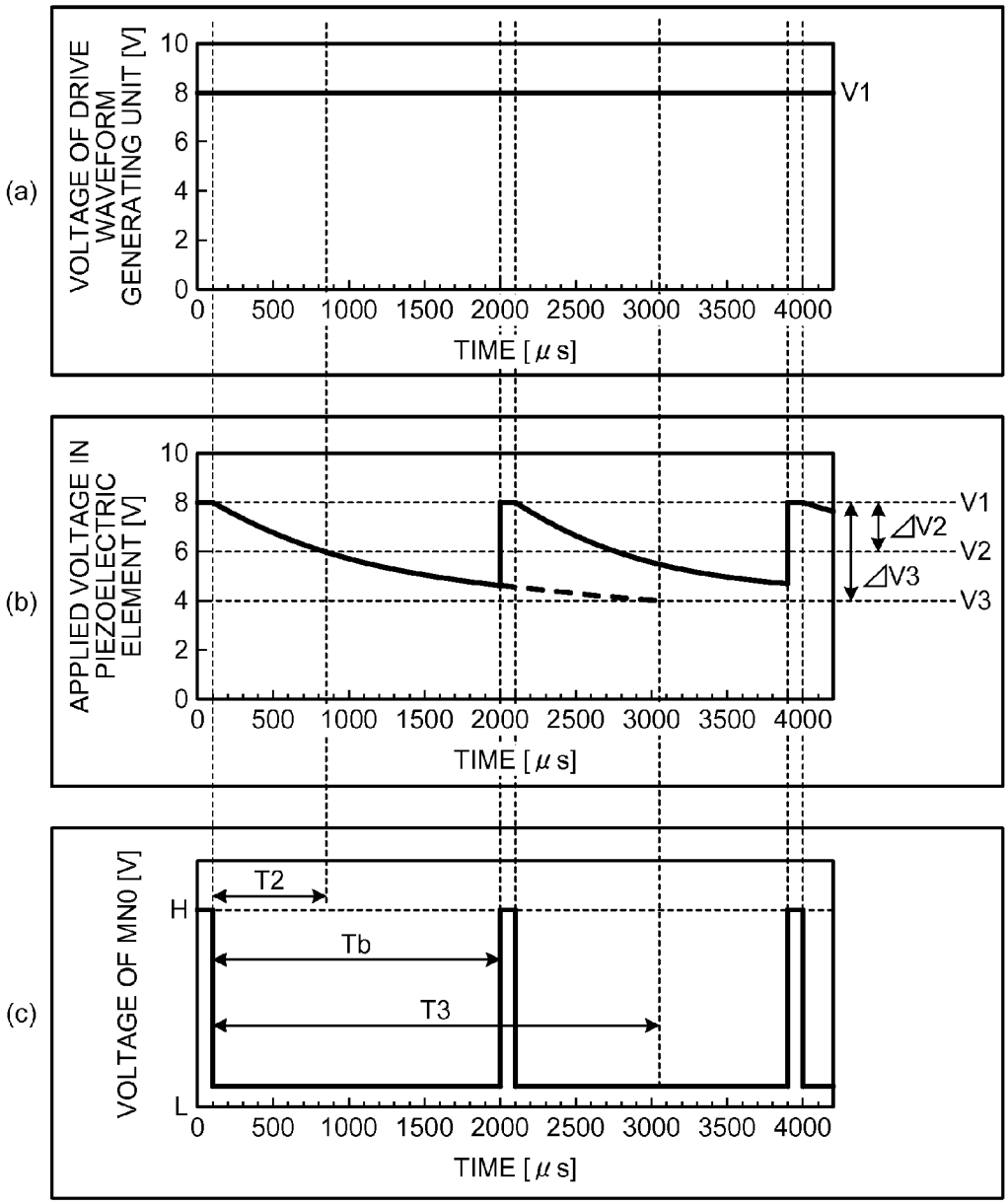
FIG. 9 is a explanatory diagram for explaining minute-drive according to an embodiment of the present invention.

This point will be described with reference to FIG. 9 and FIG. 10. FIG. 9 is an explanatory diagram for explaining the minute-drive in the present embodiment, and FIG. 10 is a explanatory diagram for explaining minute-drive in a comparative example.

FIG. 9 illustrates temporal changes in voltages during the minute-drive. FIG. 9(*a*) illustrates the voltage generated by the drive waveform generating unit 701. FIG. 9(*b*) illustrates the voltage in the piezoelectric element. The drive is performed in accordance with the potential in the piezoelectric element. FIG. 9(*c*) illustrates the voltage of an on/off switching signal for the analog switch 715 generated by the decoder 713 when the droplet control signal MN0 is selected. Only while the voltage of the on/off switching signal is equal to or greater than the value of H (on), the analog switch 715 is closed so that the voltage of the drive waveform generating unit 701 is applied to the piezoelectric element 112.

Figure 10:
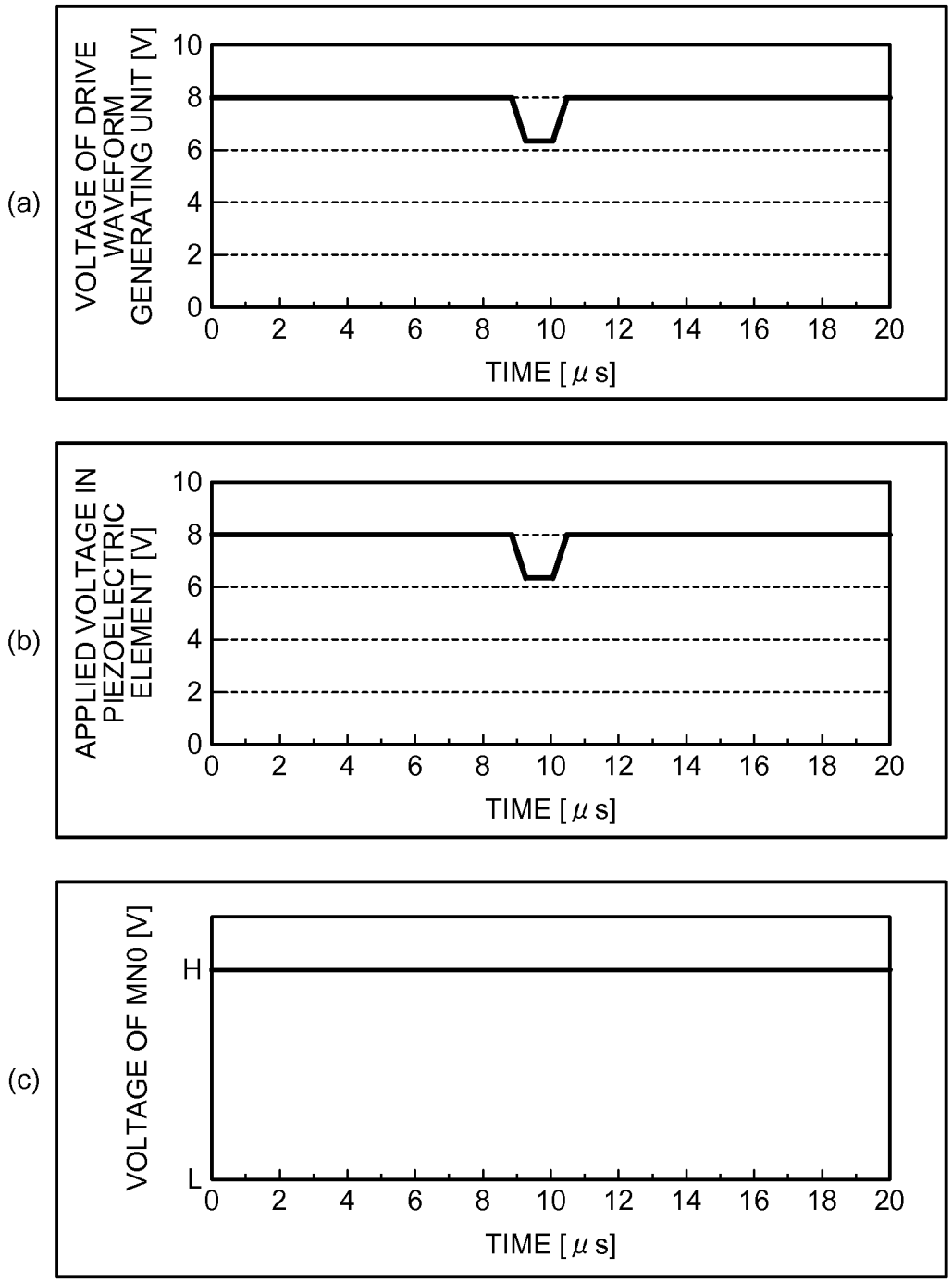
FIG. 10 is a explanatory diagrams for explaining minute-drive in a comparative example.

FIG. 10 illustrates temporal changes in voltages during conventional minute-drive in the comparative example. In the same manner as FIG. 9(*a*), FIG. 10(*a*) illustrates the voltage generated at the drive waveform generating unit 701. FIG. 10(*b*) illustrates the voltage in the piezoelectric element. The drive is performed in accordance with the potential in the piezoelectric element. FIG. 10(*c*) illustrates the voltage of the on/off switching signal for the analog switch 715 generated by the decoder 713 when the droplet control signal MN0 is selected.

Here, in FIG. 9, potentials V1 to V3 and times Ta and Tb are defined as follows.

V1: Reference potential of the drive waveform

V2: Potential lower than the potential V1 by a potential difference ΔV2 in the present embodiment, where the potential difference ΔV2 is defined as a minimum potential difference from the potential V1 required to displace the piezoelectric element to vibrate the meniscus with ejecting no liquid droplet from the nozzle V3: Potential lower than the potential V1 by a potential difference ΔV3 in the present embodiment, where the potential difference ΔV3 is defined as a minimum potential difference from the potential V1 required to displace the piezoelectric element to eject a liquid droplet from the nozzle T2: Time required for a potential to drop to the potential V2 (by the potential difference ΔV2) due to self-discharge after the piezoelectric element is charged to a predetermined potential T3: Time required for the potential to drop to the potential V3 (by the potential difference ΔV3) due to the self-discharge after the piezoelectric element is charged to a predetermined potential Ta: Time, from an immediately preceding droplet ejection operation until an abnormality occurs in the next droplet ejection operation due to that the liquid surface (nozzle meniscus) in the nozzle of the print head is dried Tb: Time for which the drive waveform generating unit and the piezoelectric element are kept electrically shut off from each other First, as illustrated in FIG. 10, in the conventional minute-drive, the drive waveform generating unit 701 indicated in FIG. 10(*a*) generates minute-drive waveform that vibrates the meniscus with ejecting no liquid droplet even while not ejecting the liquid droplets from the nozzles of the print heads or all of the nozzle rows. That is, by changing the voltage and always keeping the analog switch switching signal H (on), the potential in the piezoelectric element is changed, the piezoelectric element is driven and the minute-drive is performed.

By performing the operation described above, it is possible to vibrate (oscillate) the ink in the nozzles, and thus to suppress image deterioration due to the effect of drying. The amount of electric power consumption at this time consists of an amount of electric power consumption required to cause the voltage to rise as well as required to cause the voltage to fall and an amount of electrical power required to always charge the electricity equivalent to that of the self-discharge occurring in the piezoelectric element.

Compared with this, in the present embodiment, as illustrated in FIG. 9(*a*), when the liquid droplets are not ejected from the heads or all of the nozzle rows, the voltage generated by the drive waveform generating unit 701 always stays at the constant potential V1, and the voltage applied to the analog switch 715 is normally at L (off) and is turned to H (on) for only a predetermined period of time (for example, approximately 20 microseconds) each time the time Tb (such as approximately 500 microseconds) passes.

The voltage in the piezoelectric element drops along with the self-discharge in the piezoelectric element when the analog switch 715 is at L (off). However, when the analog switch 715 is turned to H (on), the voltage (potential V1) of the drive waveform generating unit 701 is applied to the piezoelectric element, and thereby the piezoelectric element is charged so that the voltage in the piezoelectric element increases to the same voltage value as that of the drive waveform generating unit 701.

At this time, first, the potential applied to the piezoelectric element gradually drops due to the self-discharge, so that the volume of the liquid chamber 106 slowly increases. Next, when the analog switch 715 is turned on so that the charging is performed, the volume of the liquid chamber 106 rapidly decreases, and thus, pressure energy can be given to the ink in the liquid chamber 106.

Thereby, if Ta>T2, that is, if the time for causing a potential drop by the self-discharge of the piezoelectric element sufficient to vibrate the ink meniscus at the nozzle surface is shorter than the time for the drying of the ink, it is possible to vibrate the ink meniscus, and thus to prevent droplet ejection characteristics from deteriorating due to the drying of the ink.

The amount of electric power consumption at this time is only the amount of electric charge required to recharge the electricity equivalent to that of the self-discharge that has occurred in the piezoelectric element during the time Tb.

Accordingly, compared with the electric power consumption in the conventional minute-drive by the minute-drive waveform, it is possible to suppress the amount of electric power consumption by that required to actively discharge and charge the electric charge in the piezoelectric element.

Although the above embodiment describes the example in which the voltage applied to the analog switch 715 is normally at L (off) and is turned to H (on) for only approximately 20 microseconds at intervals of Tb=approximately 500 microseconds, these values vary with various factors such as the resistance R and the capacitance C of the piezoelectric element, the value of the reference potential (initial voltage value) V1 applied to the piezoelectric element, and other factors including the shape of the head and physical properties of the liquid. Therefore, the values are not limited to the specific values described above.

In short, it is sufficient if Tb>T2 is satisfied, and that the charging time may be shorter if the quantity of electric charge in the piezoelectric element is saturated in that time.

Here, the time Tb is preferably obtained by experiment. This example will be described with reference to FIG. 12.

A liquid droplet was ejected after 15 seconds from a certain time point, and the predetermined potential V1 was repeatedly applied at intervals of Tb (100 microseconds to 10000 microseconds) for 15 seconds after the certain time point. FIG. 12 illustrates the results of this experiment when it was evaluated whether ejection of a first droplet could be observed when the droplet ejection operation was performed at a time when 15 seconds passed after the certain time point. In each item of "ejectability after being left standing" in FIG. 12, the mark "O" indicates that the ejected droplet was observed and landed approximately in a target position; the mark "Δ" indicates that the ejection was observed but a dot was greatly disarrayed; and "X" indicates that the first droplet could not be observed.

It is found that, under the conditions of this experiment, normal ejection can be performed from the first droplet if the time Tb is 2000 microseconds or longer.

Note that the minute-drive in the present embodiment is preferably performed not over the print sheet but over the maintenance and recovery mechanism because droplets might be ejected when the minute-drive is performed depending on characteristics of the voltage drop due to self-discharge.

Figure 11:
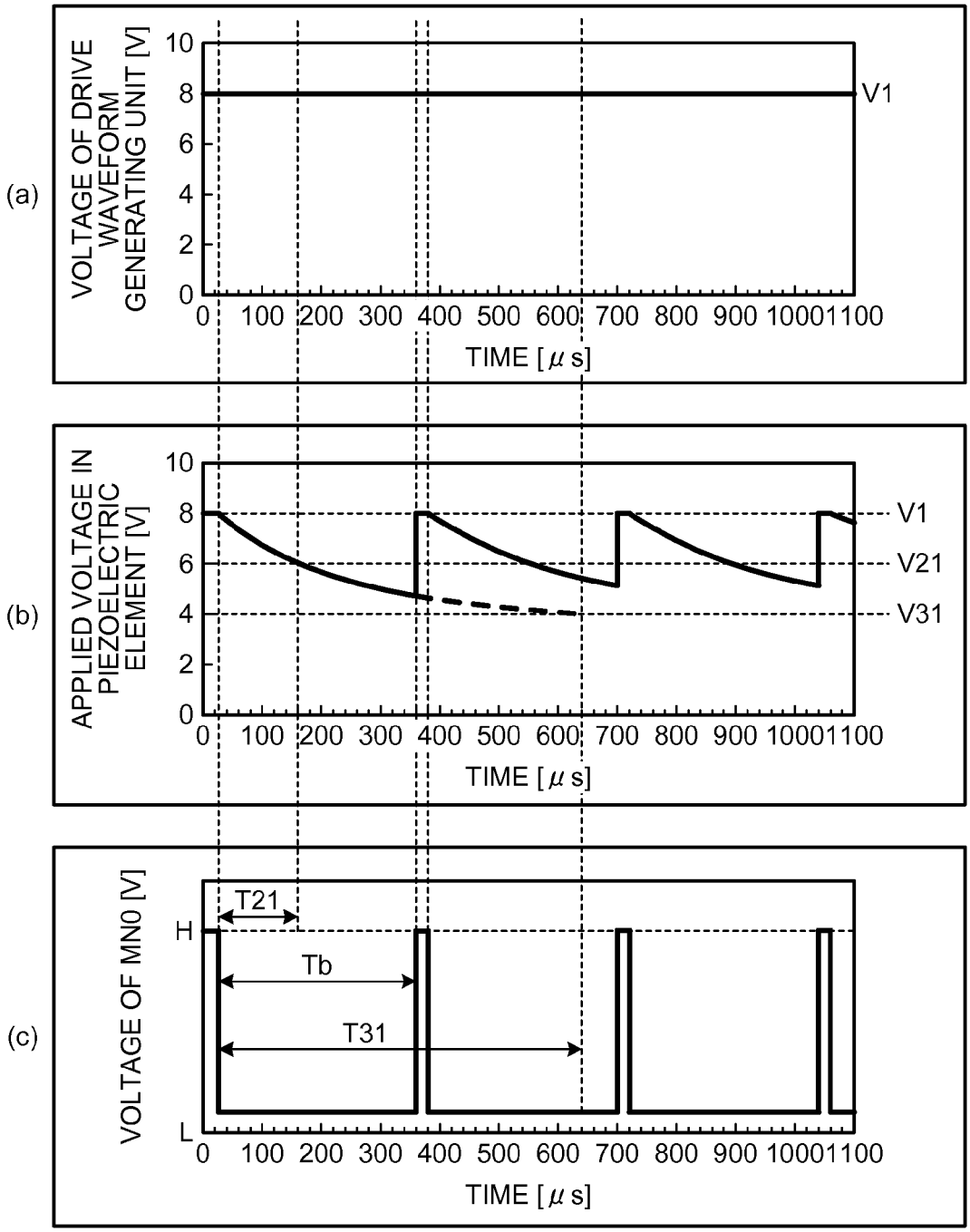
FIG. 11 is a explanatory diagram for explaining another example of the minute-drive in the embodiment.

Next, relationships with ink viscosity will be described with reference to FIG. 11. FIG. 11 is a explanatory diagram for explaining voltage changes during the minute-drive in another example of the present embodiment.

FIG. 11 is a explanatory diagram in the case in which the ink viscosity or the like is changed from those in the example illustrated in FIG. 9. Each of FIGS. 11(*a*) to 11(*c*) is similar to each of FIGS. 9(*a*) to 9(*c*).

The time T2 also changes with the ink viscosity. For example, as illustrated in FIG. 11(*b*), when the ink viscosity is lower, the ink on the nozzle meniscus surface can be moved at a potential (this is describe as "potential V21" here but this corresponds to what is called the "potential V2" in the present invention) lower than the potential V2 illustrated in FIG. 9(*b*). Therefore, as illustrated in FIG. 11(*c*), the time changes to a time (this is described as "time T21" here but this corresponds to what is called the "time T2" in the present invention) shorter that the time T2 illustrated in FIG. 9(*c*).

Accordingly, when the viscosity slightly varies among types of ink such as in the case of color ink, the value of the time Tb is preferably changed according to the viscosity of each type of ink.

Thereby, the minute-drive can be stably applied to a plurality of types on ink having different degrees of viscosity.

The ink viscosity also changes with ambient temperature, and the ink viscosity decreases and thus the ink flows more easily as the ambient temperature increases. Therefore, the ambient temperature may be detect with the temperature sensor included in the above-described sensor group 515, and, when the ambient temperature is at or above a threshold, the time Tb may be set shorter than that when the ambient temperature is below the threshold.

As the ambient humidity changes, the drying rate of the ink in the nozzle changes, and the time for the self-discharge also changes in such a manner that the time T2 increases as the ambient humidity becomes higher. Therefore, the ambient temperature may be detected with a humidity sensor included in the above-described sensor group 515, and, when the ambient humidity is at or above a threshold, the time Tb may be set longer than that when the ambient humidity is below the threshold.

Here, description will be made of the change in the time T2 due to the change in the ambient humidity, and thus, in the ink drying rate.

First, in the RC circuit composed of the piezoelectric element and the resistor, how the voltage V(t) decays can be expressed as follows.

$$V(t)=V1\times e^{-t/Rc}$$

As the ambient humidity changes, the value of the potential V2 (potential difference ΔV2) serving as a target value of V(t) changes. Specifically, the potential difference ΔV2 is the "minimum potential difference from the potential V1 required to displace the pressure generating unit to vibrate the meniscus with ejecting no liquid droplet from the nozzle," and, as the ink dries more, the viscosity of the ink increases so that a larger force (=potential) is required to vibrate the meniscus. The ink is thickened more quickly, for example, under a lower humidity, so that a larger potential difference is necessary as the required potential difference ΔV2. In order to obtain a larger amount of discharge, the discharge requires a longer period of time, and thus, the time T2 becomes longer under a lower humidity environment.

Note that, during a period in the order of several hundred microseconds to single digit milliseconds, the rate of voltage drop of V(t) due to the discharge is larger than that of rise of the potential difference ΔV2 due to the thickening. Therefore, the time T2 does excessively increases and thus the discharge does not become incapable of catching up the rate of thickening.

Although, in the above-described embodiment, the voltage generated at the drive waveform generating unit 701 always stays at the constant value of the potential V1, the voltage does not always need to be constant. If the voltage stays at the potential V1 at least only in a time period sufficient to perform stable charging to the piezoelectric element, the voltage in the other time period may have a lower value, such as "0", than the potential V1, or may, on the contrary, have a higher value than the potential V1.

Although, in the above-described embodiment, the piezoelectric element is used as the pressure generating unit, it is possible to use another pressure generating unit that operates in response to change in potential and that is subject to self-discharge, such as an electrostatic actuator that generates displacement by applying a potential difference between mutually opposing flexible electrodes.

While, in the above-described first embodiment, the time Tb satisfies the relation with the time T2, Tb≥T2, the time Tb is further set to satisfy a relation with the time T3, Tb<T3, that is, set to satisfy the relation T3>Tb≥T2.

Here, as described above, the time T3 is the time required for the voltage dropping due to the self-discharge to reach the potential V3 corresponding to the minimum value of the voltage change in the pressure generating unit required to eject a liquid droplet. Therefore, setting the time Tb smaller than the time T3 prevents ejection of the liquid droplet due to the minute-drive.

Herewith, the print heads does not need to move to a position including an ink collecting mechanism such as the maintenance and recovery mechanism or the idle ejection receiver, and thus, the minute-drive according to the present invention can be performed until immediately before printing, thus, making it possible to reduce the electric power consumption to a larger extent.

It is not necessary to always perform the minute-drive in the present invention during the non-ejection drive, and all power supplies may be turned off when the image formation is not performed for a long time. Also, the minute-drive in the present invention can be used in combination with conventional minute-drive.

Note that, in the present application, the term "sheet" does not limit the material to paper, but includes an OHP sheet, a fabric, glass, and a substrate. The term "sheet" means something to which ink droplets or other liquid, or the like can adhere, and includes what are called recorded medium, recording medium, recording sheet, and recording paper. The terms image formation, recording, character printing, imaging, and printing are all synonyms.

The term "image forming apparatus" means an apparatus that performs image formation by ejecting liquid onto a medium such as paper, a string, a fiber, a cloth, a leather, metal, plastic, glass, wood, or ceramics. The term "image formation" means to attach an image carrying a meaning such as a character or a figure onto a medium, and in addition, to attach an image carrying no meaning such as a pattern onto a medium (to simply land liquid droplets onto a medium).

The term "ink" is not limited, unless particularly limited, to what is called ink, but is used as a collective term for all types of liquid that can be used for image formation, such as what are called recording liquid, fixing solution, and liquid. The term "ink" includes, for example, a DNA sample, resist, pattern material, and resin.

The "image" is not limited to be a planar image, but also includes an image attached to a three-dimensionally formed object and an image formed by three-dimensionally shaping a solid body itself.

The image forming apparatus includes, unless particularly limited, both a serial-type image forming apparatus and a line-type image forming apparatus.

The embodiment of the present invention can reduce electric power consumption.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a print head including a plurality of nozzles configured to eject droplets of liquid and a plurality of pressure generating units configured to generate pressure to eject the droplets of liquid from the plurality of nozzles, the plurality of pressure generating units being units in which self-discharge occurs;

a drive waveform generating unit configured to generate a drive waveform applied to each of the plurality of pressure generating units in the print head; and a unit configured to, when one or more of the plurality of nozzles are not ejecting any droplet of liquid, electrically shut off one or more of the plurality of pressure generating units corresponding to the one or more of the plurality of nozzles, from the drive waveform generating unit for a period of a time Tb that is equal to or greater than a time T2, maintain the drive waveform at a reference potential V1, and apply, at a time after the shutoff, the reference potential V1 to the one or more of the plurality of pressure generating units for a period of time that is less than the time T2, wherein a minimum potential difference from the reference potential V1 required to displace a pressure generating unit to vibrate a meniscus of one or more of the plurality of nozzles that are not ejecting any liquid droplet of liquid is denoted as ΔV2, a time required for a potential to drop by the minimum potential difference ΔV2 due to the self-discharge after a pressure generating unit is charged to a target electric potential is denoted as the time T2, a time, from an immediately preceding droplet of liquid ejection operation until an abnormality occurs in a next droplet of liquid ejection operation due to a dried liquid surface in one of the plurality of nozzles of the print head is denoted as a time Ta, a time to hold a state in which the drive waveform generating unit and the one or more of the plurality of pressure generating units are electrically shut off from each other is denoted as the time Tb, and the time Ta is greater than the time T2.

2. The image forming apparatus according to claim 1, wherein a minimum potential difference from the reference potential V1 required to displace a pressure generating unit to eject a liquid droplet from one of the plurality of nozzles is denoted as ΔV3, a time required for the potential to drop by the minimum potential difference ΔV3 due to the self-discharge after the one or more pressure generating units is charged to the target electric potential is denoted as a time T3, and the time T3 is greater than the time Tb.

3. The image forming apparatus according to claim 1, wherein an ambient temperature is detected, and when the ambient temperature is at or above a threshold, the time Tb is set shorter than that when the ambient temperature is below the threshold.

4. The image forming apparatus according to claim 1, wherein an ambient humidity is detected, and when the ambient humidity is at or above a threshold, the time Tb is set shorter than that when the ambient humidity is below the threshold.

5. The image forming apparatus according to claim 1, further comprising:

a plurality of print heads or a print head having a plurality of nozzle rows, either of which is configured to eject liquids having different colors, wherein the time Tb is set depending on viscosity of each of the liquids.

6. A method of controlling a print head having a plurality of nozzles ejecting droplets of liquid and a plurality of pressure generating units generating pressure to eject the droplets of liquid from the plurality of nozzles, the plurality of pressure generating units being units in which self-discharge occurs, the method comprising:

causing a drive waveform generating unit to generate a drive waveform applied to each of the plurality of pressure generating units in the print head; and when one or more of the plurality of nozzles are not ejecting any droplet of liquid, electrically shutting off one or more of the plurality of pressure generating units corresponding to the one or more of the plurality of nozzles, droplet, from the drive waveform generating unit for a period of a time Tb that is equal to or greater than a time T2, maintaining the drive waveform at a reference potential V1 when the one or more of the plurality of nozzles are not ejecting any droplet of liquid, and applying, at a time after the shutoff, the reference potential V1 to the one or more of the plurality of pressure generating units for a period of time that is less than the time T2, wherein a minimum potential difference from the reference potential V1 required to displace a pressure generating unit to vibrate a meniscus of one or more of the plurality of nozzles that are not ejecting any liquid droplet is denoted as ΔV2, a time required for a potential to drop by the minimum potential difference ΔV2 due to the self-discharge after a pressure generating unit is charged to a target electric potential is denoted as the time T2, a time, from an immediately preceding droplet of liquid ejection operation until an abnormality occurs in a next droplet of liquid ejection operation due to a dried liquid surface in one of the plurality of nozzles of the print head is denoted as a time Ta, a time to hold a state in which the drive waveform generating unit and the one or more of the plurality of pressure generating units are electrically shut off from each other is denoted as the time Tb, and the time Ta is greater than the time T2.

* * * * *